US011299910B2

(12) United States Patent
Huang

(10) Patent No.: US 11,299,910 B2
(45) Date of Patent: Apr. 12, 2022

(54) DEADBOLT LOCK

(71) Applicant: TAIWAN FU HSING INDUSTRIAL CO., LTD., Kaohsiung (TW)

(72) Inventor: Chao-Ming Huang, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 291 days.

(21) Appl. No.: 16/528,850

(22) Filed: Aug. 1, 2019

(65) Prior Publication Data

US 2020/0318386 A1 Oct. 8, 2020

(30) Foreign Application Priority Data

Apr. 8, 2019 (TW) ..... 108204220

(51) Int. Cl.

| | |
|---|---|
| ***E05B 15/00*** | (2006.01) |
| ***E05B 17/20*** | (2006.01) |
| ***E05B 9/04*** | (2006.01) |
| ***E05C 9/02*** | (2006.01) |

(52) U.S. Cl.

CPC ..... *E05B 17/2084* (2013.01); *E05B 9/04* (2013.01); *E05C 9/026* (2013.01)

(58) Field of Classification Search

CPC ..... E05B 15/00; E05B 15/10; E05B 17/2084; E05B 9/026

USPC ..... 70/416, 417, 134, 370

See application file for complete search history.

(56) References Cited

U.S. PATENT DOCUMENTS 3,713,683 A * 1/1973 Neary ..... E05B 63/0017 292/336.3
4,047,408 A * 9/1977 Johns ..... E05B 63/0017 70/129
4,073,172 A * 2/1978 Schlage ..... E05B 17/2084 70/370
4,338,804 A * 7/1982 Solovieff ..... E05B 15/1614 292/337
4,489,576 A * 12/1984 Mullich ..... E05B 63/0017 292/1.5
4,593,546 A * 6/1986 Allen ..... E05B 17/042 70/134

(Continued)

FOREIGN PATENT DOCUMENTS

CA 2612101 A1 5/2008

OTHER PUBLICATIONS

Requisition and Search Report for counterpart Canadian Application No. 3051923, dated Apr. 8, 2021.

*Primary Examiner* — Suzanne L Barrett
(74) *Attorney, Agent, or Firm* — Rosenberg, Klein & Lee

(57) ABSTRACT

A deadbolt lock includes a positioning member mounted to a lock part. A protective member includes a recess formed in one side thereof and is mounted to the lock part and the positioning member. A covered area is formed between the positioning member and the protective member. At least one fixing member is connected to the positioning member and located within the covered area. An outer cover is mounted to the protective member and the positioning member. The at least one fixing member is compact in size to reinforce the protective member to reduce manufacturing cost. The protective member and the outer cover are not damaged by impact from outside of the deadbolt lock to enhance safety features of the deadbolt lock.

15 Claims, 10 Drawing Sheets

(56) References Cited

U.S. PATENT DOCUMENTS

| | | | | | |
|---|---|---|---|---|---|
| 5,216,910 | A * | 6/1993 | Lin | E05B 15/1614 | 70/370 |
| 5,540,070 | A * | 7/1996 | Adelmeyer | E05B 17/0058 | 70/370 |
| 5,722,273 | A * | 3/1998 | Lin | E05B 17/0058 | 292/147 |
| 5,906,125 | A * | 5/1999 | Shen | E05B 17/0058 | 70/370 |
| 6,230,528 | B1 * | 5/2001 | Don | E05B 15/02 | 70/224 |
| 6,840,070 | B1 * | 1/2005 | Huang | E05B 3/06 | 292/348 |
| 7,389,660 | B2 * | 6/2008 | Ebling | E05B 9/08 | 70/370 |
| 7,596,975 | B1 * | 10/2009 | Yuan | E05B 9/08 | 70/134 |
| 2002/0096893 | A1 * | 7/2002 | Wu | E05B 15/0053 | 292/347 |
| 2002/0108409 | A1 * | 8/2002 | Beatty | E05B 9/082 | 70/134 |
| 2003/0041633 | A1 * | 3/2003 | Britz | E05B 9/08 | 70/134 |
| 2005/0011240 | A1 * | 1/2005 | Huang | E05B 9/082 | 70/370 |
| 2006/0179904 | A1 * | 8/2006 | Shen | E05B 63/0017 | 70/370 |
| 2008/0121002 | A1 * | 5/2008 | Sun | E05B 15/02 | 70/124 |

* cited by examiner

DEADBOLT LOCK

BACKGROUND OF THE INVENTION

1. Fields of the Invention

The present invention relates to a deadbolt lock, and more particularly, to a deadbolt lock with a protective member wherein the fixing members are located within the covered area formed by the protective member so as to reinforce the protective member.

2. Descriptions of Related Art

The conventional locks are used for safety reason, and the locks are installed to doors, for example, to prevent unauthorized persons from entering the rooms. Generally, the lock is able to be unlocked by using a correct key from the outside of the door, and the lock can also be unlocked by a knob from the inside of the door. The lock cylinder is located in the lock and can only be rotated by using the correct key.

One of the malicious methods to unlock the lock is to break the outer cover of the lock cylinder directly and then pick the cylinder out to fail the protection feature of the cylinder. Therefore, the lock can be unlocked regardless of the complication of the lock. It is obvious that how to reinforce the outer cover is one of the main concerns for a lock.

The present invention intends to provide a deadbolt lock to eliminate the shortcomings mentioned above.

SUMMARY OF THE INVENTION

The present invention relates to a deadbolt lock and comprises a positioning member mounted to a lock part. A protective member includes a recess formed in one side thereof, and the protective member is mounted to the lock part. The protective member is mounted to the first side of the positioning member. A covered area is formed between the positioning member and the protective member. At least one fixing member is connected to the positioning member and located within the covered area. An outer cover is mounted to the protective member and mounted to the positioning member.

Preferably, the protective member includes at least one connection portion which is located corresponding to the at least one fixing member. The positioning member includes at least one connection hole which is located corresponding to the at least one fixing member. The at least one fixing member is a bolt. The at least one connection portion and the at least one connection hole each are a threaded hole.

Preferably, a mounting member is connected to the second side of the positioning member and is located opposite to the protective member. The mounting member includes at least one positioning hole through which the at least one fixing member extends.

Preferably, the positioning member includes a tubular portion. The protective member includes a mounting hole. The lock part extends through the mounting hole and the tubular portion.

Preferably, the lock part includes at least one positioning portion. The tubular portion includes at least one fixing member which is located corresponding to the at least one positioning portion.

Preferably, the at least one positioning portion is a threaded hole. The tubular portion includes at least one through hole which is located corresponding to the at least one positioning portion. The at least one fixing member extends through the at least one through hole and is connected to the at least one positioning portion.

Preferably, the lock part includes a lock cylinder which is not detached from the lock part. The lock cylinder is used to unlock the lock part.

Preferably, the lock part includes a lock cylinder which is detachable from the lock part and includes a keyhole. The lock part includes a receiving hole defied in the first end thereof. The lock cylinder is received in the receiving hole. The lock part includes a face hole formed in the second end of the lock part. The face hole is located corresponding to the keyhole. An end cover is fixed to the first end of the lock part to position the lock cylinder in the receiving hole.

Preferably, the lock part includes at least one installation hole which is a threaded hole. The end cover includes at least one passage. At least one fastening member extends through the at least one passage and is connected to the at least one installation hole. The at least one fastening member is a bolt.

Preferably, the outer cover includes a bore through which the lock part is received. A lip extends inward and radially from the inner periphery of the bore. The lock part includes a flange, and the diameter of the flange is larger than the inner diameter of the lip and smaller than the inner diameter of the bore.

Preferably, an anti-break member is located in the covered area and includes at least one slot which is located corresponding to the at least one fixing member.

Preferably, the anti-break member is a plastic member or a metal member.

Preferably, the lock part is connected to a latch part which is driven by the lock part. An escutcheon includes a driving member which is connected to the latch part and drives the latch part. The escutcheon includes a securing member which includes a restriction face and a contact portion protruding from the restriction face. The restriction face and the contact portion face the latch part. The securing member is connected to a disk which includes at least one restriction member extending from the first side thereof that faces the contact portion. The disk includes a protrusion extending from the second side thereof. The protrusion is located corresponding to the restriction face. When the disk is located at a first position, the at least one restriction member contacts the contact portion, and the protrusion protrudes beyond the escutcheon. When the disk is flipped to a second position, the protrusion contacts the restriction face, and the at least one restriction member protrudes beyond the escutcheon.

Preferably, the at least one restriction member is located in a ring-shaped arrangement. The outer diameter of the at least one restriction member is larger than that of the protrusion.

The advantages of the present invention are that because of the fixing members, when the protective member and the outer cover are hit and deformed, thanks to the strength of the fixing members, the protective member and the outer cover, and the lock part is positioned by the fixing members such that the protective member and the outer cover are not damaged or shifted to expose the lock part. The safety feature, anti-theft feature and strength of the deadbolt lock of the present invention are enhanced.

By the securing member and the disk, the deadbolt lock of the present invention can be installed to doors of different lock holes by selectively flipping the disk to the first position or the second position. The contact portion or the protrusion contacts the inner periphery of the door lock hole to allow the deadbolt lock of the present invention to be installed to doors of different lock holes.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
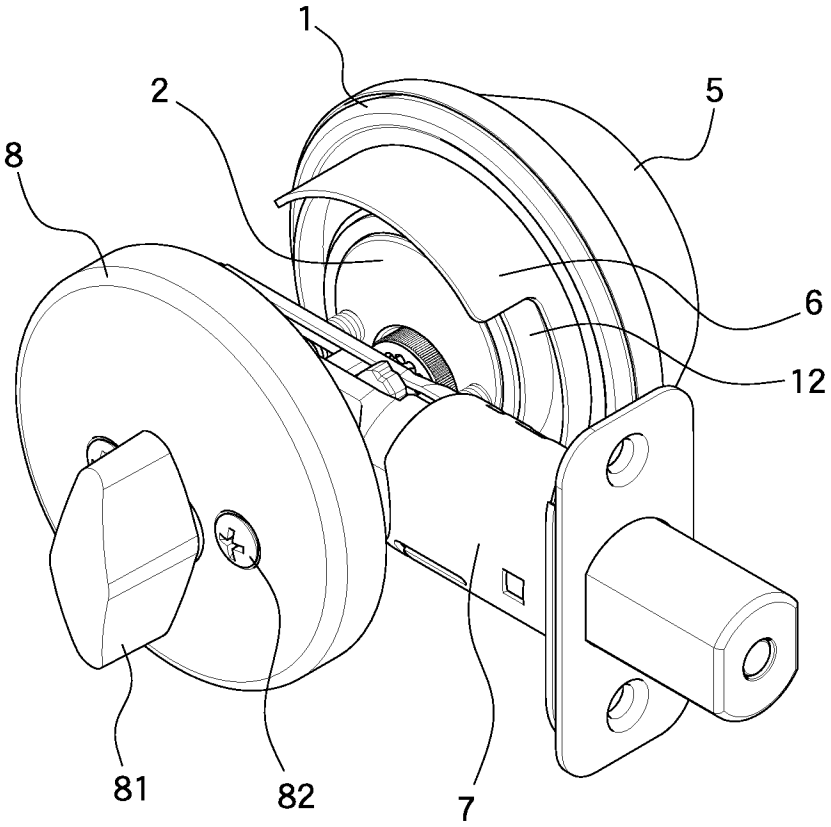
FIG. 1 is a perspective view to show the deadbolt lock of the present invention.
Figure 2:
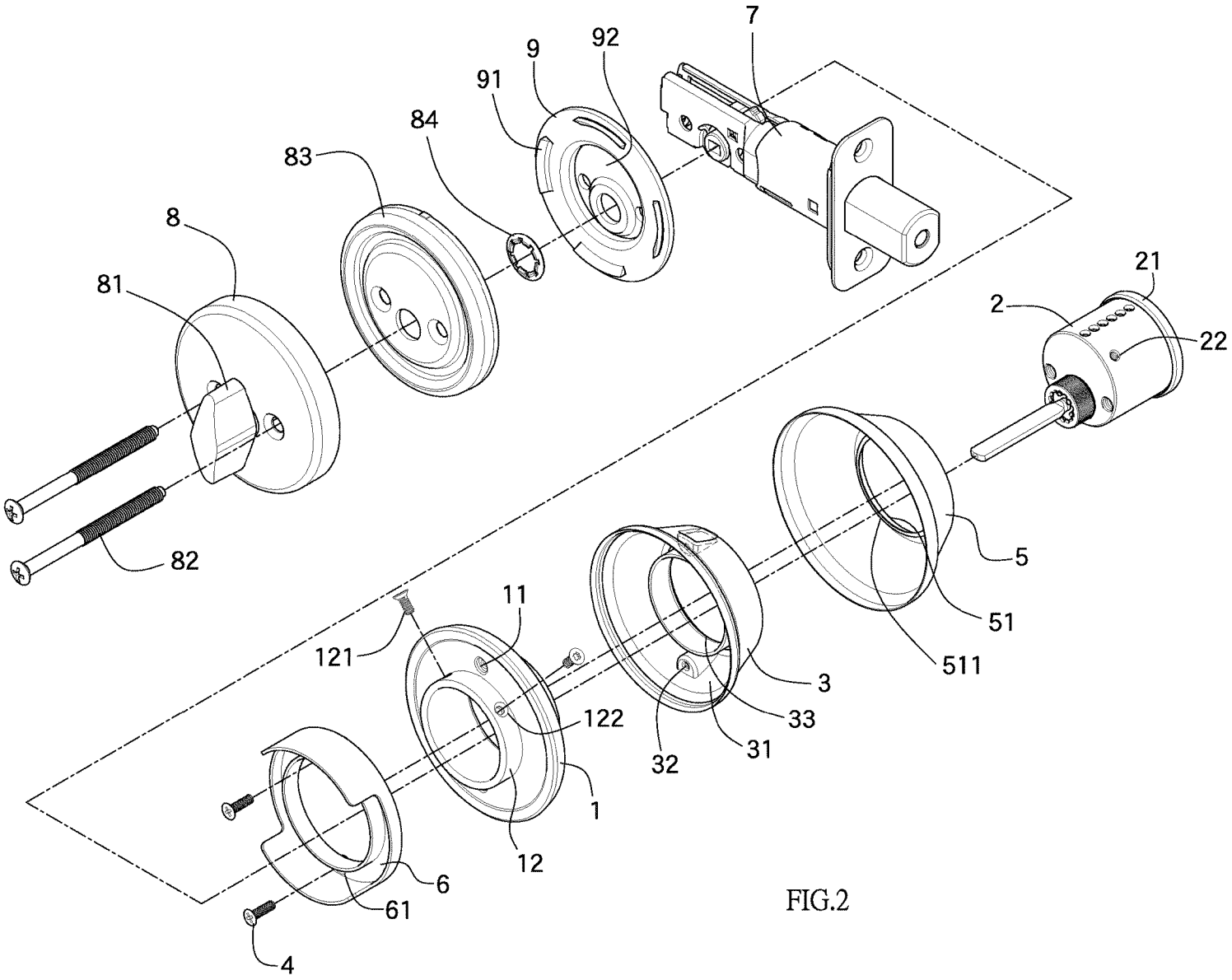
FIG. 2 is an exploded view of the deadbolt lock of the present invention.
Figure 3:
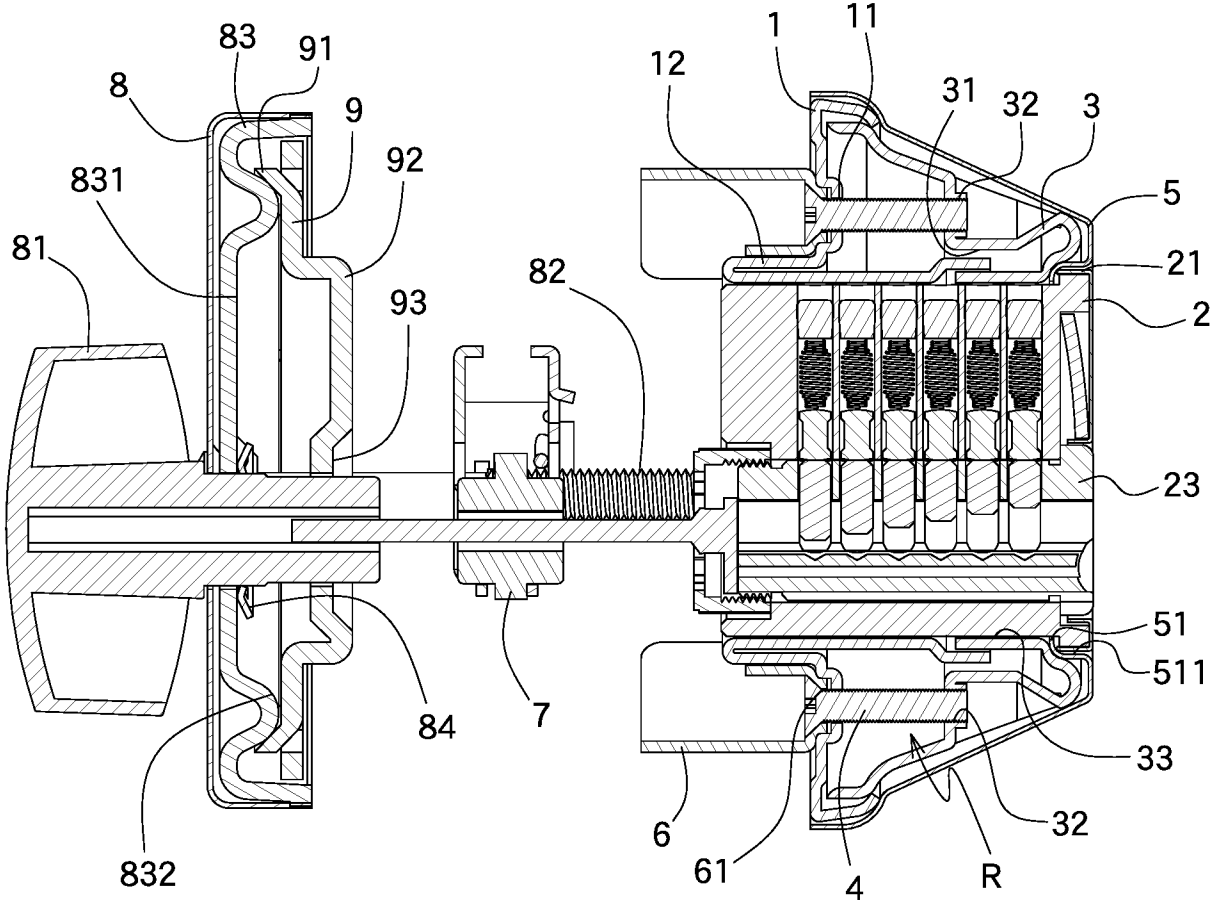
FIG. 3 is a cross sectional view to show that the deadbolt lock of the present invention is in the first position.

Referring to FIGS. 1 to 3, the deadbolt lock of the present invention comprises a positioning member 1 mounted to a lock part 2. A protective member 3 includes a recess 31 formed in one side thereof. The protective member 3 is mounted to the lock part 2 and the protective member 3 is mounted to the first side of the positioning member 1. A covered area "R" is formed between the positioning member 1 and the protective member 3. At least one fixing member 4 is connected to the positioning member 1 and located within the covered area "R".

It is noted that the at least one fixing member 4 is required to be located within the covered area "R". The at least one fixing member 4 can either contact the inside of the protective member 3, or does not contact the inside of the protective member 3. When the protective member 3 is hit to form dents, the at least one fixing member 4 supports the protective member 3 so that the protective member 3 is reinforced with low cost.

In one embodiment, in order to position the at least one fixing member 4 and allow the at least one fixing member 4 to support, the protective member 3 includes at least one connection portion 32 to which the at least one fixing member 4 is connected. In order to easily install, assemble and remove the at least one fixing member 4, the at least one connection portion 32 is a threaded hole, and the at least one fixing member 4 is a bolt. The positioning member 1 includes at least one connection hole 11 which is located corresponding to the at least one fixing member 4. The at least one connection hole 11 is a threaded hole. The at least one fixing member 4 extends through the at least one connection hole 11 and is connected to the at least one connection portion 32. The at least one fixing member 4 reinforces the protective member 3, and also is helpful for assembling between the positioning member 1 and the protective member 3.

In another embodiment, an outer cover 5 is mounted to the protective member 3 and the positioning member 1. The outer cover 5 includes a bore 51 through which the lock part 2 is received. A lip 511 extends inward and radially from the inner periphery of the bore 51. The lock part 2 includes a flange 21. The diameter of the flange 21 is larger than the inner diameter of the lip 511 and smaller than the inner diameter of the bore 51. The flange 21 is axially in contact with the lip 511 of the outer cover 5.

In one embodiment, the positioning member 1 includes a tubular portion 12, and the protective member 3 includes a mounting hole 33. The tubular portion 12 and the mounting hole 33 are located outside of the lock part 2. In yet another embodiment, in order to increase stability between the positioning member 1 and the lock part 2, and in order to prevent the lock part 2 from shifting due to impact, the lock part 2 includes at least one positioning portion 22, and the tubular portion 12 includes at least one fixing member 121 which is located corresponding to the at least one positioning portion 22. Specifically, the tubular portion 12 includes at least one through hole 122 which is located corresponding to the at least one positioning portion 22. The at least one fixing member 121 is a bolt and extends through the at least one through hole 122 and is connected to the at least one positioning portion 22 so as to fix the lock part 2 to the tubular portion 12 of the positioning member 1.

The positioning member 1 is fixed to one side of a door (not shown), it is well known that the door includes a door hole and a lateral hole which is used to lock the door. In order to install the present invention to the door, a mounting member 6 is connected to the second side of the positioning member 1 and is located opposite to the protective member 3, so that the mounting member 6 is inserted into the door hole to prevent the positioning member 1 from slipping relative to the side of the door. The mounting member 6 includes at least one positioning hole 61 through which the at least one fixing member 4 extends. The at least one fixing member 4 extends through the at least one positioning hole 61 and the at least one connection hole 11 so as to be connected to the at least one connection portion 32. When the door has a smaller door hole, the mounting member 6 can be omitted optionally.

Figure 4:
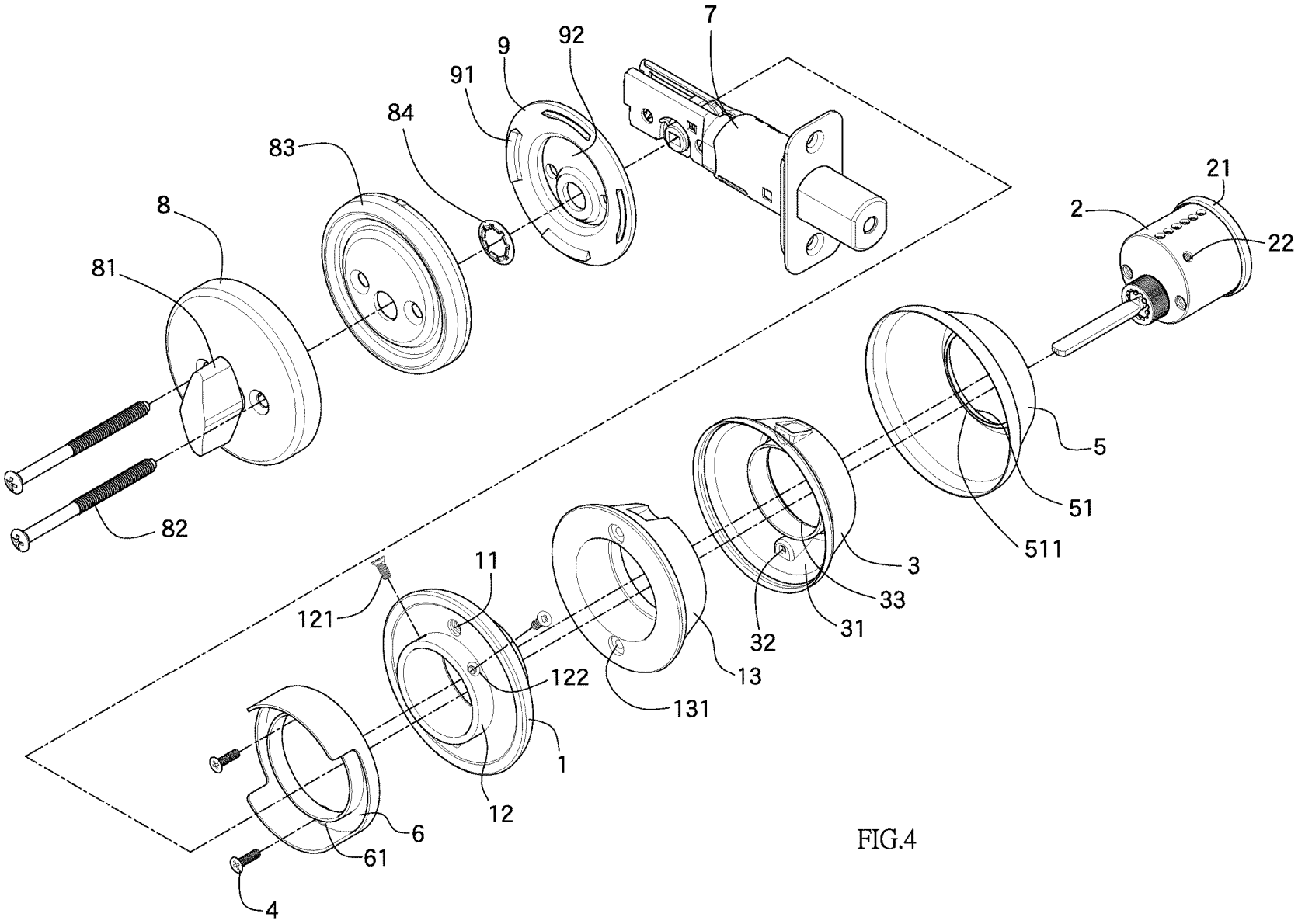
FIG. 4 is an exploded view of the deadbolt lock of the present invention wherein the anti-break member is disclosed.
Figure 5:
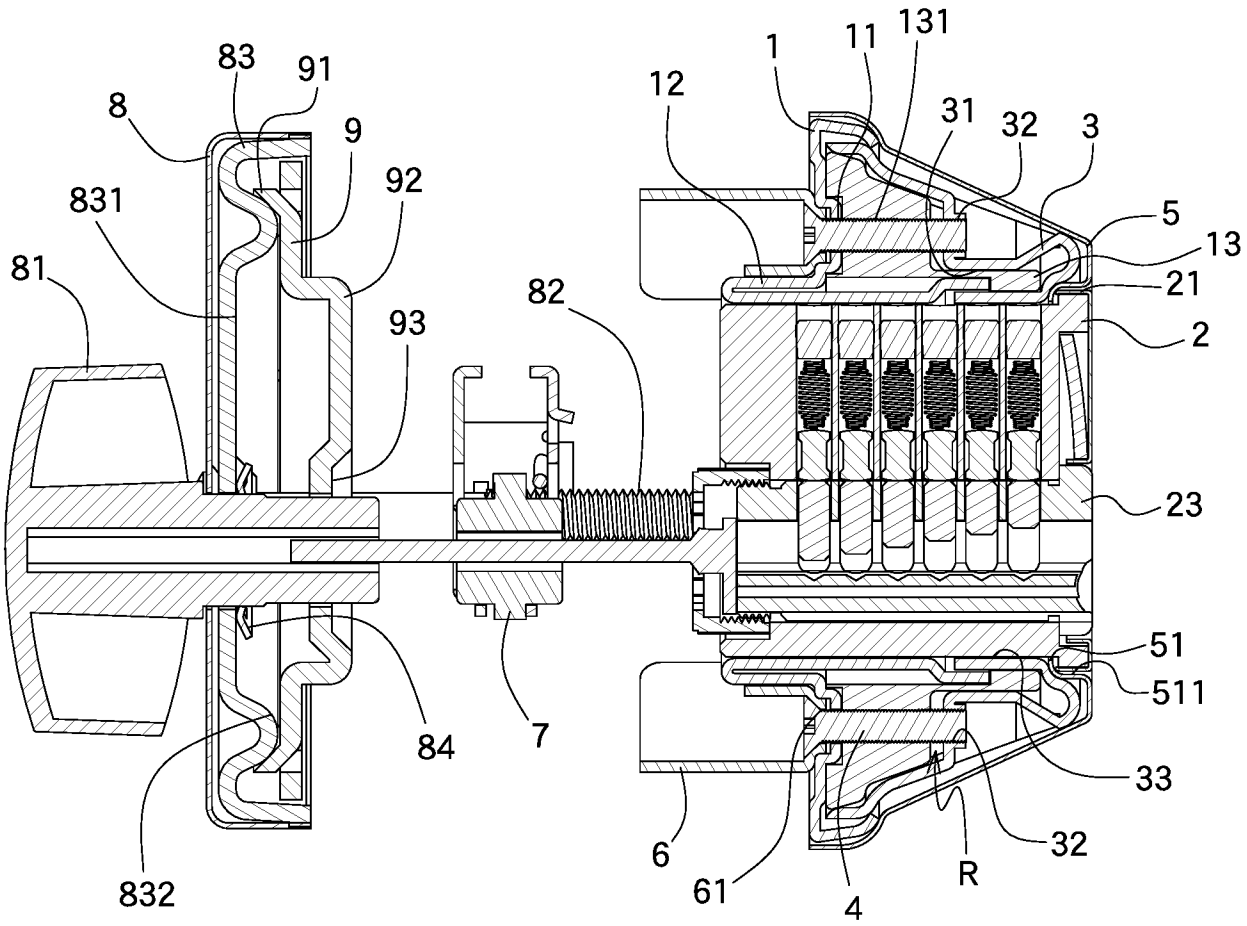
FIG. 5 is a cross sectional view of the deadbolt lock of the present invention with the anti-break member.

When the present invention is installed to a door which is required to have higher standard of safety, as shown in FIGS. 4 and 5, an anti-break member 13 is located in the covered area "R". The anti-break member 13 is a plastic member or a metal member. The anti-break member 13 includes at least one slot 131 which is located corresponding to the at least one fixing member 4. The at least one fixing member 4 may pass through or be located in the at least one slot 131. Therefore, the protective member 3 is filled with the anti-break member 13 and is supported by the anti-break member 13. Therefore, the protective member 3 is not deformed due to hit so as to increase the anti-theft feature. The anti-break member 13 can be optionally installed so that the present invention can be used in wide range of applications and reduces the manufacturing cost.

Figure 6:
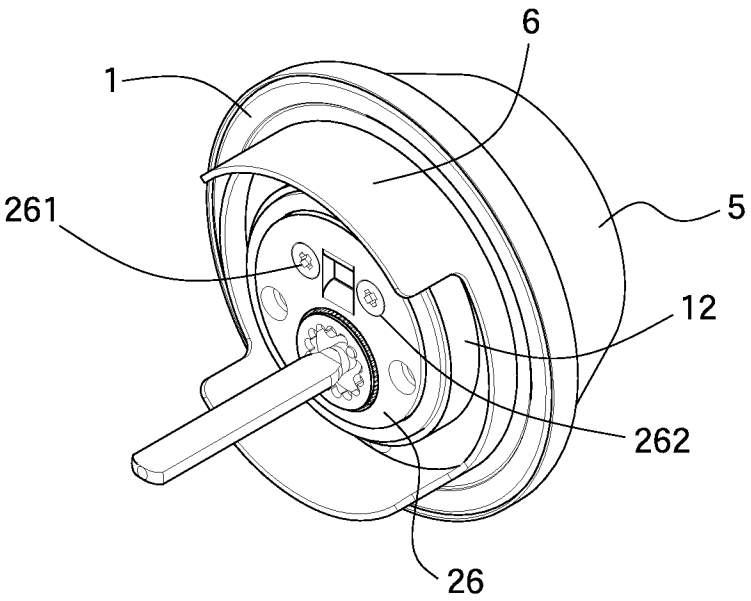
FIG. 6 shows the lock part with the detachable lock cylinder of the present invention.
Figure 7:
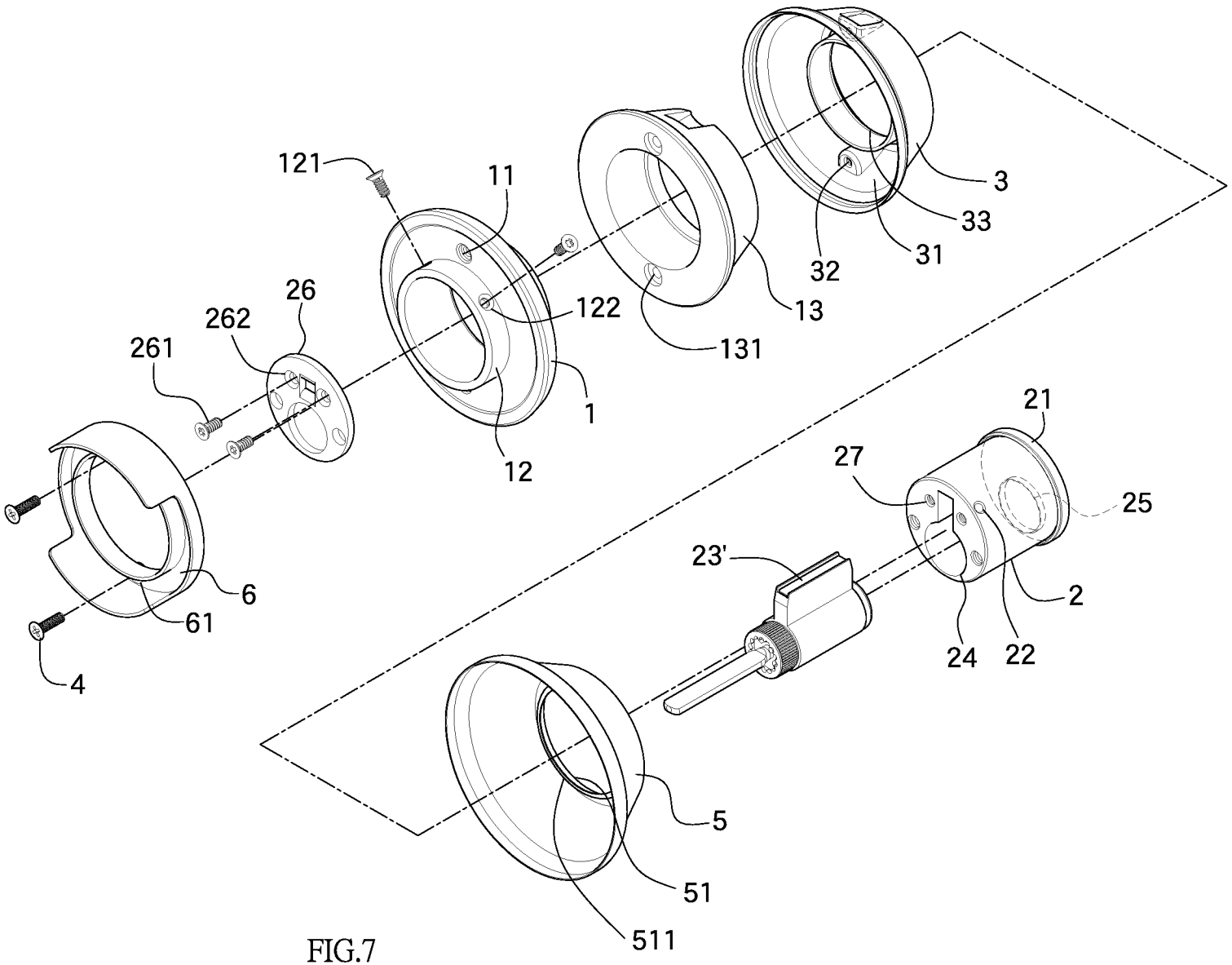
FIG. 7 is an exploded view to show the lock part with the detachable lock cylinder of the present invention.
Figure 8:
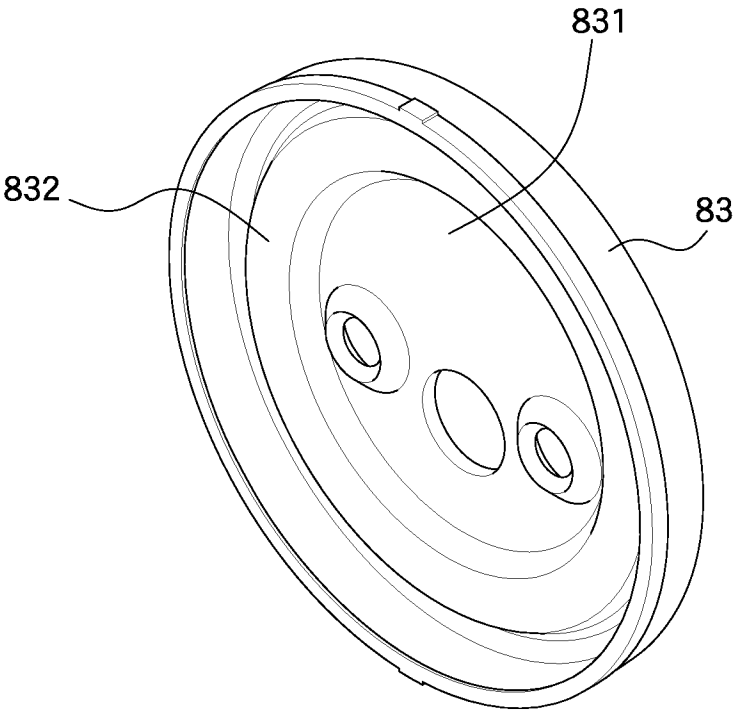
FIG. 8 shows another view of the securing member.
Figure 9:
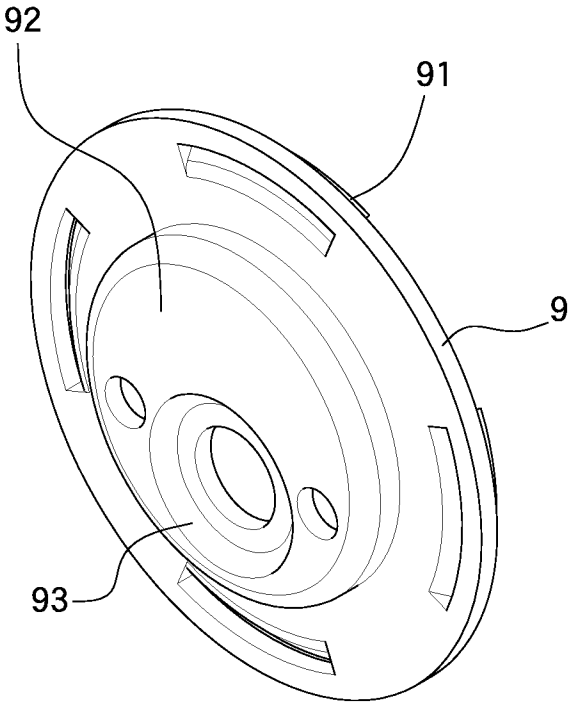
FIG. 9 shows another view of the disk.

Generally, the lock part 2 includes a lock cylinder 23 so as to lock or unlock the lock part 2. In this embodiment, the lock part 2 includes a lock cylinder 23 which is not detached from the lock part 2. In another embodiment, as shown in FIGS. 6 and 7, the lock cylinder 23' is detachable from the lock part 2 and includes a keyhole. The lock part 2 includes a receiving hole 24 defined in the first end thereof. The lock cylinder 23' is received in the receiving hole 24. The lock part 2 includes a face hole 25 formed in the second end of the lock part 2. The face hole 25 is located corresponding to the keyhole. An end cover 26 is fixed to the first end of the lock part 2 to position the lock cylinder 23' in the receiving hole 24. Preferably, the lock part 2 includes at least one installation hole 27 which is a threaded hole. The end cover 26 includes at least one fastening member 261 which is fixed to the at least one installation hole 27. The end cover 26 includes at least one passage 262 located corresponding to the at least one installation hole 27. The at least one fastening member 261 is a bolt and extends through the at least one passage 262 and is connected to the at least one installation hole 27 so as to fix the end cover 26 to the lock part 2 and to secure the lock cylinder 23' and to prevent the lock part 2 and the lock cylinder 23' from shifting due to impact.

As shown in FIGS. 1 to 3 and 8 to 9, the lock part 2 is located at one end of the positioning member 1 and connected to a latch part 7 which is driven by the lock part 2. An escutcheon 8 is located opposite to the positioning member 1 and includes a driving member 81 which is connected to the latch part 7 and drives the latch part 7. For the axial direction of the lock part 2, the escutcheon 8 is connected to the lock part 2 by the locking members 82. The escutcheon 8 and the positioning member 1 clamp the door therebetween by a known way. The escutcheon 8 includes a securing member 83 which includes a restriction face 831 and a contact portion 832 protruding from the restriction face 831. The restriction face 831 and the contact portion 832 face the latch part 7. The securing member 83 is connected to a disk 9 which includes at least one restriction member 91 extending from the first side thereof that faces the contact portion 832. The disk 9 includes a protrusion 92 extending from the second side thereof. The protrusion 92 is located corresponding to the restriction face 831.

When the disk 9 is located at a first position, as shown in FIG. 3 or 5, the at least one restriction member 91 contacts the contact portion 832, and the protrusion 92 protrudes beyond the escutcheon 8, so that the protrusion is installed to the door hole with a small diameter.

Figure 10:
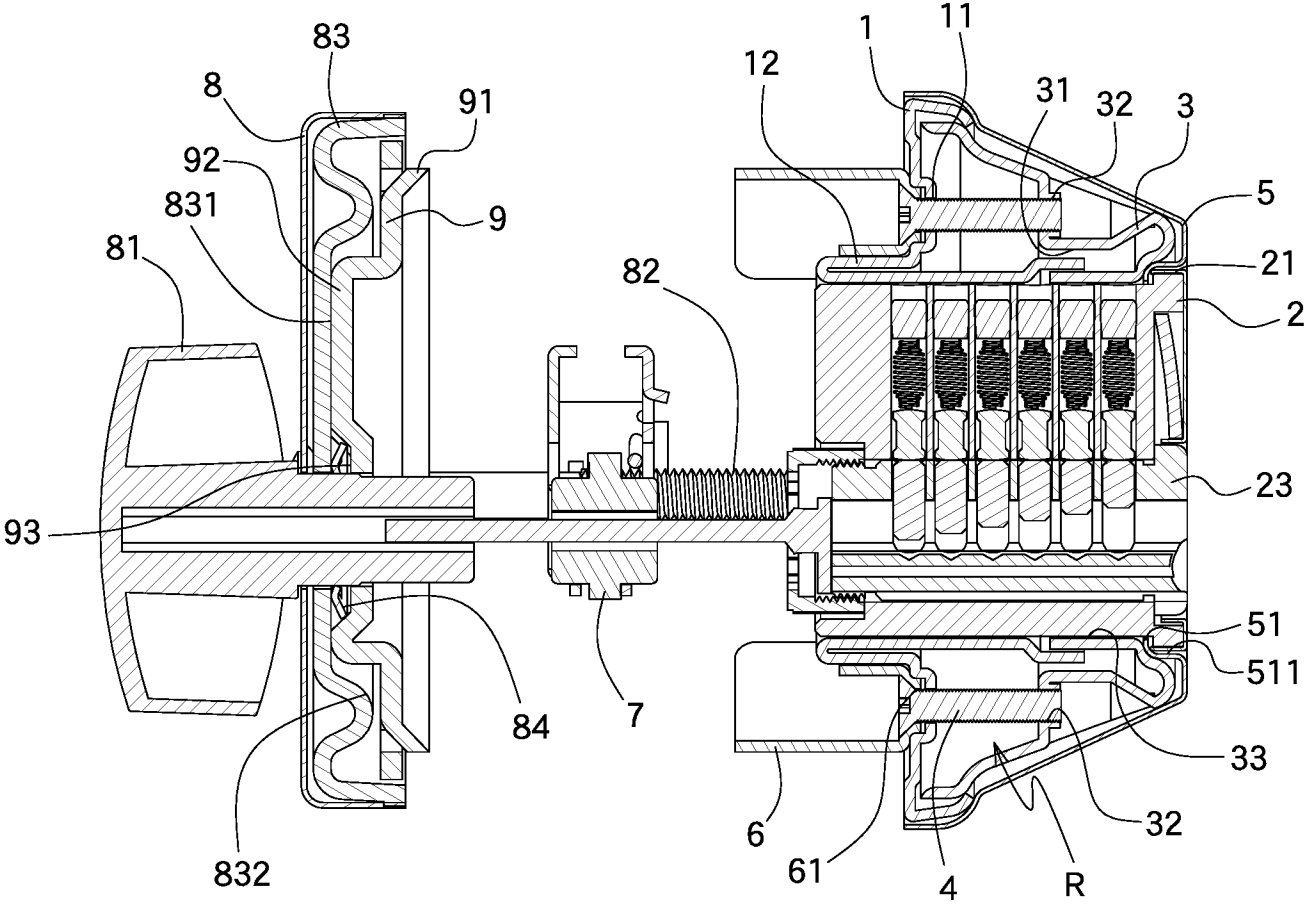
FIG. 10 is a cross sectional view to show that the deadbolt lock of the present invention is in the second position.

As shown in FIG. 10, when the disk 9 is flipped to a second position, the protrusion 92 contacts the restriction face 831, and the at least one restriction member 91 protrudes beyond the escutcheon 8. Preferably, the at least one restriction member 91 is located in a ring-shaped arrangement. The outer diameter of the at least one restriction member 91 is larger than that of the protrusion 92. When the door hole is a large hole, the at least one restriction member 91 is engaged with the door hole. Therefore, the present invention can be installed to doors with the door holes of different sizes.

In yet another embodiment, in order to install the driving member 81, there are related parts located at the inside wall of the escutcheon 8 as in the embodiment, when the driving member 81 is a knob, there are a positioning ring 84 located at the inside wall of the escutcheon 8. The positioning ring 84 is located at the restriction face 831 and located opposite the escutcheon 8. In order to prevent the protrusion 92 from being interfered by the positioning ring 84 when the protrusion 92 contacts the restriction face 831, the protrusion 92 includes at least one recessed area 93 so as to receive the positioning ring 84 such that the protrusion 92 contacts the restriction face 831 as expected and is not interfered by other parts.

While we have shown and described the embodiment in accordance with the present invention, it should be clear to those skilled in the art that further embodiments may be made without departing from the scope of the present invention.

What is claimed is:

1. A deadbolt lock comprising:

a positioning member mounted to a lock part, an outer periphery of the positioning member forming a bent portion, the bent portion defining a mounting space on a first side of the positioning member;

a protective member having a recess formed in one side thereof, the protective member mounted to the lock part, the protective member mounted to the first side of the positioning member within the mounting space of the positioning member, a covered area formed between the positioning member and the protective member;

at least one fixing member connected to the positioning member and located within the covered area, and an outer cover mounted to the protective member and the positioning member.

2. The deadbolt lock as claimed in claim 1, wherein:

the at least one fixing member is a bolt having a threading and extending in an extension direction, the protective member includes at least one connection portion which is located corresponding to the at least one fixing member and extends in a direction substantially perpendicular to the extension direction of the at least one fixing member, the positioning member includes at least one connection hole which is located corresponding to the at least one fixing member, and the at least one connection portion and the at least one connection hole each are a threaded hole, the threading of the at least one fixing member thereby engaging with the at least one connection portion and the at least one connection hole.

3. The deadbolt lock as claimed in claim 1, wherein:

a mounting member is connected to a second side of the positioning member and is located opposite to the protective member, and the mounting member includes at least one positioning hole through which the at least one fixing member extends.

4. The deadbolt lock as claimed in claim 1, wherein:

the positioning member includes a tubular portion, the protective member includes a mounting hole, and the lock part extends through the mounting hole and the tubular portion.

5. The deadbolt lock as claimed in claim 4, wherein:

the lock part includes at least one positioning portion, and the tubular portion includes at least one second fixing member which is located corresponding to the at least one positioning portion.

6. The deadbolt lock as claimed in claim 5, wherein:

the at least one positioning portion is a threaded hole, the tubular portion includes at least one through hole which is located corresponding to the at least one positioning portion, and the at least one second fixing member extends through the at least one through hole and is connected to the at least one positioning portion.

7. The deadbolt lock as claimed in claim 5, wherein:

the lock part includes a lock cylinder which is not detached from the lock part, and the lock cylinder is used to unlock the lock part.

8. The deadbolt lock as claimed in claim 5, wherein:

the lock part includes a lock cylinder which is detachable from the lock part and includes a keyhole, the lock part includes a receiving hole defined in a first end thereof, the lock cylinder is received in the receiving hole, the lock part includes a face hole formed in a second end of the lock part, the face hole is located corresponding to the keyhole, and an end cover is fixed to the first end of the lock part to position the lock cylinder in the receiving hole.

9. The deadbolt lock as claimed in claim 8, wherein:

the lock part includes at least one installation hole which is a threaded hole, the end cover includes at least one passage, at least one fastening member extends through the at least one passage and is connected to the at least one installation hole, and the at least one fastening member is a bolt.

10. The deadbolt lock as claimed in claim 1, wherein:

the outer cover includes a bore through which the lock part is received, a lip extends inward and radially from an inner periphery of the bore, the lock part includes a flange, and a diameter of the flange is larger than an inner diameter of the lip and smaller than an inner diameter of the bore.

11. A deadbolt lock, comprising:

a positioning member mounted to a lock part, the lock part including a lock cylinder;

a protective member having a recess formed in one side thereof, the protective member mounted to the lock part, the protective member mounted to a first side of the positioning member, a covered area formed between the positioning member and the protective member;

an outer cover mounted to the protective member and the positioning member; and an anti-break member disposed in the covered area and surrounding the lock cylinder, the anti-break member including at least one slot; and at least one fixing member connected to the positioning member and located in the at least one slot of the anti-break member.

12. The deadbolt lock as claimed in claim 11, wherein the anti-break member is a plastic member or a metal member.

13. The deadbolt lock as claimed in claim 1, wherein:

the lock part is connected to a latch part which is driven by the lock part, an escutcheon includes a driving member which is connected to the latch part and drives the latch part, a securing member which includes a restriction face, a positioning ring formed on the restriction face, and a contact portion protruding from the restriction face, the restriction face and the contact portion facing the latch part, the securing member is connected to a disk which includes at least one restriction member extending from a first side thereof that faces the contact portion, a protrusion extending from a second side thereof, and a recessed area formed in the second side thereof, the protrusion being located corresponding to the restriction face and the recessed area being located corresponding to the positioning ring, when the disk is located at a first position, the at least one restriction member contacts the contact portion, and the protrusion protrudes beyond the escutcheon, and when the disk is flipped to a second position, the protrusion contacts the restriction face, the recessed area receives the positioning ring, and the at least one restriction member protrudes beyond the escutcheon.

14. The deadbolt lock as claimed in claim 13, wherein:

the at least one restriction member is located in a ring-shaped arrangement, and an outer diameter of the at least one restriction member is larger than that of the protrusion.

15. The deadbolt lock as claimed in claim 1, wherein the bent portion of the positioning member is engaged with an outer surface of the protective member.

* * * * *